US007041238B2

(12) United States Patent
Kim et al.

(10) Patent No.: US 7,041,238 B2
(45) Date of Patent: May 9, 2006

(54) CONDUCTIVE POLYMER HAVING POSITIVE TEMPERATURE COEFFICIENT, METHOD OF CONTROLLING POSITIVE TEMPERATURE COEFFICIENT PROPERTY OF THE SAME AND ELECTRICAL DEVICE USING THE SAME

(75) Inventors: Do-Yun Kim, Seoul (KR); Jong-Ho Lee, Kyunggi-do (KR); Soo-An Choi, Kyunggi-do (KR); Joon-Koo Han, Seoul (KR); Chang-Mo Ko, Kyunggi-do (KR)

(73) Assignee: LG Cable Ltd., Seoul (KR)

( * ) Notice: Subject to any disclaimer, the term of this patent is extended or adjusted under 35 U.S.C. 154(b) by 231 days.

(21) Appl. No.: 10/487,956

(22) PCT Filed: Apr. 25, 2002

(86) PCT No.: PCT/KR02/00762

§ 371 (c)(1),
(2), (4) Date: Feb. 25, 2004

(87) PCT Pub. No.: WO03/019578

PCT Pub. Date: Mar. 6, 2003

(65) Prior Publication Data

US 2004/0232387 A1 Nov. 25, 2004

(30) Foreign Application Priority Data

Aug. 25, 2001 (KR) ..... 2001-51568

(51) Int. Cl.
*H01B 1/22* (2006.01)
*H01B 1/24* (2006.01)
*H01C 7/02* (2006.01)

(52) U.S. Cl. ..... 252/511; 252/512; 252/514; 338/22 R

(58) Field of Classification Search ..... 252/511, 252/512, 514; 338/22 R
See application file for complete search history.

(56) References Cited

U.S. PATENT DOCUMENTS 3,243,753 A 3/1966 Kohler (Continued)

FOREIGN PATENT DOCUMENTS

JP 60-031548 2/1985

(Continued)

*Primary Examiner*—Mark Kopec
(74) *Attorney, Agent, or Firm*—Jones Day

(57) ABSTRACT

PTC conductive polymer composition includes organic polymer containing polyolefin components essentially consisting of 30~40 w % high density polyethylene (HDPE), 20~40 w % low density polyethylene (LDPE) and 10~30 w % ethylene-acrylic-acid (EAA) or ethylene-vinyl-acetate (EVA), and 20~30 w % high or low density polyethylene which is denaturated into maleic anhydride compound; 60~120 w % electrical conductive particles dispersed into the organic polymer, the electrical conductive particles by weight of the organic polymer; and 0.2~0.5 w % peroxidic cross-linking agent added for cross-linking reaction by weight of the organic polymer. Thus, it becomes possible to control PTC characteristics such as switching temperature and trip time of an electrical device by suitably adjusting an added amount of the polyethylene, which is denaturated into maleic anhydride compound.

13 Claims, 2 Drawing Sheets

U.S. PATENT DOCUMENTS

| | | | |
|---|---|---|---|
| 3,823,217 | A | 7/1974 | Kampe |
| 3,950,604 | A | 4/1976 | Penneck |
| 4,188,276 | A | 2/1980 | Lyons et al. |
| 4,272,471 | A | 6/1981 | Walker |
| 4,414,301 | A | 11/1983 | Constein |
| 4,425,397 | A | 1/1984 | George |
| 4,426,339 | A | 1/1984 | Kamath et al. |
| 4,427,877 | A | 1/1984 | Dhingra |
| 4,429,216 | A | 1/1984 | Brigham |
| 4,442,139 | A | 4/1984 | Brigham |
| 5,880,668 | A * | 3/1999 | Hall ..... 338/22 R |
| 6,059,997 | A | 5/2000 | Hall |

FOREIGN PATENT DOCUMENTS

| | | | |
|---|---|---|---|
| JP | 61-181859 | A * | 8/1986 |
| JP | 62-181347 | | 8/1987 |
| JP | 02-021601 | | 7/1988 |
| JP | 05-226112 | | 2/1992 |
| KR | 1999-63872 | | 7/1999 |

* cited by examiner

CONDUCTIVE POLYMER HAVING POSITIVE TEMPERATURE COEFFICIENT, METHOD OF CONTROLLING POSITIVE TEMPERATURE COEFFICIENT PROPERTY OF THE SAME AND ELECTRICAL DEVICE USING THE SAME

TECHNICAL FIELD

The present invention relates to a positive temperature coefficient (PTC) composite and an electrical device containing the PTC composite. More particularly, the present invention relates to a PTC composite, which is made by adding polyethylene, on which a maleic anhydride is grafted, into a maleic anhydride for the purpose of easy control of switching temperature and trip time.

BACKGROUND ART

PTC means a characteristic that electrical resistance rapidly increases at a relatively narrow temperature range due to increase of temperature. PTC composites have such PTC characteristics and they are generally used in a circuit protection element, which limits current of a circuit when the circuits such as a heater, a positive-characterized thermistor, an ignition sensor, a battery or the like are short-circuited. The circuit protection element makes the circuit recovered when the cause of the short circuit is removed.

As another example employing the PTC composites, there is a PTC element in which at least two electrodes are electrically connected to such composites. Such a PTC element is used as an element for preventing over current or overheat, which acts for self-control of temperature, as described above.

Over-current prevention mechanism using the PTC element is as follows. At an ambient temperature, the PTC composite has a sufficiently low resistance, so ensuring current flow through a circuit. However, if a high current passes through the circuit due to, for example, a short circuit, this high current causes Joule heat generated in the PTC element, which increases temperature and therefore raises resistance of the element by the PTC characteristics. This resistance blocks current flow through the element, so protecting the circuit. It is generally referred as a current limiting property.

Such PTC element, or PTC composite, needs to have a current limiting property, which can repeatedly work even under high voltage. Also, improvement of the current limiting property comes from sufficient decrease of an initial resistance of the PTC element as well as endowment of the effective PTC characteristics.

There are developed many kinds of PTC composites. As an example, a PTC composite made by adding univalent or trivalent metal oxide to $BaTiO_3$ is already well known. However, such composite has a problem that it allows current flow less than 1 msec because it shows NTC (Negative Temperature Coefficient) characteristics right after the PTC characteristics is manifested.

As an alternation, there has been developed a PTC composite, which is made by dispersing electrical conductive particles such as carbon black, carbon fiber, carbon graphite or metal particles to an organic polymer such as polyethylene, polypropylene or ethylene-acrylic acid copolymer. Such PTC composite is generally made by blending a necessary amount of electrical conductive particles into at least one resin, used as an organic polymer.

Reference can be made for example to U.S. Pat. No. 3,243,753, U.S. Pat. No. 3,823,217, U.S. Pat. No. 3,950,604, U.S. Pat. No. 4,188,276, U.S. Pat. No. 4,272,471, U.S. Pat. No. 4,414,301, U.S. Pat. No. 4,425,397, U.S. Pat. No. 4,426,339, U.S. Pat. No. 4,427,877, U.S. Pat. No. 4,429,216, U.S. Pat. No. 4,442,139 and so on.

In addition, Korean Patent Publication No. 99-63872 discloses a technique of grafting conductive particulate fillers into maleic anhydride grafted polyethylene in order to make a PTC composite. This PTC composite may show great adhesion to a metal electrode with a soft surface, recover its initial or lower resistance after repeated cycling (that is, changing from a low resistance state to a high resistance state and then returning), and extend a period of a tripped state.

However, any one among them does not show a technique to control a switching temperature and a trip time by adding polyethylene, on which a maleic anhydride is grafted, into crystalline polymer compounds.

DISCLOSURE OF INVENTION

Inventors of the present invention have discovered that it is possible to control a switching temperature and a trip time by adding low-density polyethylene (LDPE) or high-density polyethylene (HDPE), on which a maleic anhydride is grafted, into a mixture of HDPE, LDPE, ethylene-ethyl acrylate copolymer (EEA), ethylene-acrylic-acid (EAA) or ethylene-vinyl-acetate (EVA).

An object of the present invention is to provide a PTC composite for easily controlling a switching temperature and a trip time thereof, and a method of controlling such PTC characteristics.

Another object of the present invention is to provide a PTC composite with excellent heat-stability and conductivity by conducting cross-linking reaction to conductive polymer compounds with use of a peroxidic cross-linking agent.

In order to accomplish the above objects, the present invention provides an organic positive temperature coefficient (PTC) composite which includes organic polymer made by adding 20~30 w % of high density polyethylene (HDPE) or low density polyethylene (LDPE) on which a maleic anhydride is grafted into polyolefin components containing 30~40 w % of HDPE, 20~40 w % of LDPE and 10~30 w % ethylene-acrylic-acid (EAA) or ethylene-vinyl-acetate (EVA); 60~120 w % of electrical conductive particles dispersed into 100 w % of the organic polymer; and 0.2~0.5 w % of peroxidic cross-linking agent added into 100 w % of the organic polymer for cross-linking reaction.

Thus, a switching temperature and a trip time can be controlled by suitably adjusting an added amount of the maleic anhydride grafted polyethylene.

As another aspect of the present invention, there is provided a method of controlling positive temperature coefficient (PTC) characteristics of an organic PTC composite which is made by dispersing electrical conductive particles such as carbon black into polyolefin component containing 30~40 w % of high density polyethylene (HDPE), 20~40 w % of low density polyethylene (LDPE) and 10~30 w % ethylene-acrylic-acid (EAA) or ethylene-vinyl-acetate (EVA) and then cross-linking the polyolefin component with peroxidic cross-linking agent, wherein the method comprises the step of controlling a switching temperature (Ts) and a trip time by adding 20~30 w % of HDPE or LDPE on which a maleic anhydride is grafted to the polyolefin component.

At this time, as an added amount of the maleic anhydride grafted polyethylene increases, the switching temperature and the trip time are also decrease.

As still another aspect of the present invention, there is also provided an electrical device which includes a PTC element having organic polymer made by adding 20~30 w % of high density polyethylene (HDPE) or low density polyethylene (LDPE), on which maleic anhydride is grafted into a maleic anhydride compound, into polyolefin components containing 30~40 w % of HDPE, 20~40 w % of LDPE and 10~30 w % ethylene-acrylic-acid (EAA) or ethylene-vinyl-acetate (EVA); 60~120 w % of electrical conductive particles dispersed into 100 w % of the organic polymer; and 0.2~0.5 w % of peroxidic cross-linking agent added into 100 w % of the organic polymer for cross-lining reaction, and a pair of electrodes connectable to a power source, respectively, the electrodes allowing current to flow through the PTC element when being connected to the power source.

Suggested in this invention is an organic PTC (Positive Temperature Coefficient) composite which has a resistivity of 0.8~2.0 Ω-cm at an ambient temperature, shows excellent temperature-resistance characteristic and current-time characteristic and maintains its specific resistance to an initial state after repeated increases and decreases of temperature.

More concretely, the organic PTC composite is made by adding electrical conductive particulate fillers such as carbon block and maleic anhydride grafted LDPE (or HDPE) into an organic polymer compound containing HDPE, LDPE, EEA (Ethylene-ethyl Acrylate Copolymer), EVA (Ethylene-Vinyl-Acetate), EAA (Ethylene-Acrylic-Acid) and so on, and then cross-linking the mixture with a cross-linking agent. The PTC composite may also additionally include antioxidant, inert filler, stabilizer, dispersing agent and so on.

The organic polymer of the present invention contains 30~40 w % of HDPE, 20~40 w % of LDPE and 10~30 w % EAA, EVA or EEA.

A suitable content of maleic anhydride grafted HDPE or LDPE added to the organic polymer is preferably 20~30 w %.

As the conductive particulate filler, powder nickel, gold dust, powder copper, silvered powder copper, metal-alloy powder, carbon black, carbon powder or carbon graphite can be used. Among them, carbon black is most preferred as the conductive particulate filler in the present invention.

An added amount of the carbon black is preferably about 30~60 w % by weight of the organic polymer.

An amount of the peroxidic cross-linking agent added for cross-linking reaction is suitably about 0.3~0.8 w %.

In addition, a preferred amount of the antioxidant added as an additional agent is 0.2~0.5 w %.

The organic PTC composite described above can be disposed between two metal film electrodes to make an electrical device having PTC characteristics. Such an electrical device having PTC characteristics is described in FIG. 1. As shown in FIG. 1, the electrical device includes two metal film electrodes 1 and a PTC element 2 united between them. Such a PTC element 2 has the organic PTC composite described above.

As the metal electrode, copper plating or nickel plating is preferably used.

BRIEF DESCRIPTION OF THE DRAWINGS

These and other features, aspects, and advantages of the present invention will become better understood with regard to the following description, appended claims, and accompanying drawings, in which like components are referred to by like reference numerals. In the drawings:

BEST MODES FOR CARRYING OUT THE INVENTION

Hereinafter, a PTC composite and a method of making an electrical device using the PTC composite according to the present invention will be described in detail.

A mixture including organic polymer made by adding 20~30 w % of high density polyethylene (HDPE) or low density polyethylene (LDPE) on which maleic anhydride is grafted into polyolefin components containing 30~40 w % of HDPE, 20~40 w % of LDPE and 10~30 w % ethylene-acrylic-acid (EAA) or ethylene-vinyl-acetate (EVA); 60~120 w % of electrical conductive particles dispersed into 100 w % of the organic polymer; and 0.2~0.5 w % of peroxidic cross-linking agent added into 100 w % of the organic polymer for cross-linking reaction is blended in a Banbury mixer during 20~30 minutes at above a melting temperature.

The blended mixture is molded at a temperature of 140° C. for 2 minutes under a pressure of 300 kg/cm$^2$ to make a PTC element of 5 mm thickness.

Figure 1:
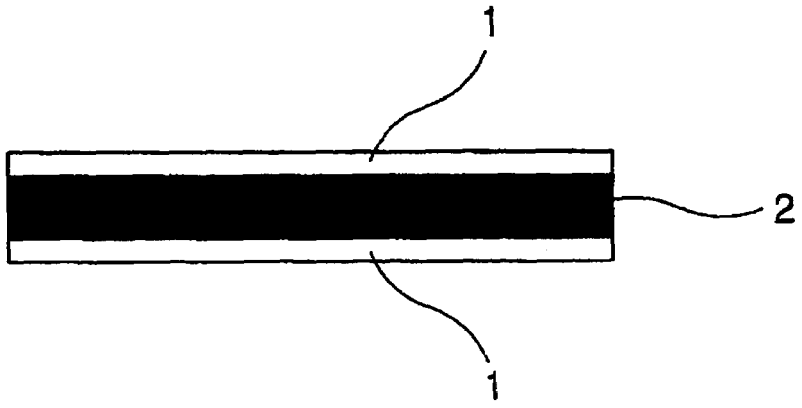
FIG. 1 is a sectional view showing an electrical device according to the present invention.

This PTC element is bonded to the metal electrodes at a suitable temperature, and then cross-linked and cooled to eventually make the electrical device as shown in FIG. 1.

The electrical device has the PTC element (or, conductive complex) surrounded by two metal film electrodes, in which the metal electrodes has a thickness of 15~50 μm and the PTC element has a thickness of 150~400 μm. The finished electrical device has a disk shape, and more preferably, has a doughnut shape with a suitable-sized hole at its center.

Now, embodiments of the present invention are described in detail.

EMBODIMENT 1

Make an organic PTC composite by adding 70 w % of carbon black, 0.3 w % of antioxidant and 0.2 w % of peroxidic cross-linking agent into 100 w % of the organic polymer which contains 35 w % of HDPE (High-Density. Polyethylene) having a density of 0.95~0.965 g/cm$^3$ and a 3~6 melt index, 35 w % of LDPE (Low-Density Polyethylene) having a density of 0.90~0.93 g/cm$^3$ and a 3~6 melt index and 30 w % of EVA (Ethylene-Vinyl Acetate).

EMBODIMENT 2

Make an organic PTC composite by adding 70 w % of carbon black, 0.3 w % of antioxidant and 0.2 w % of peroxidic cross-linking agent into 100 w % of the organic polymer which contains 30 w % of HDPE having a density of 0.95~0.965 g/cm$^3$ and a 3~6 melt index, 30 w % of LDPE having a density of 0.90~0.93 g/cm$^3$ and a 3~6 melt index, 10 w % of EVA and 30 w % of LDPE on which maleic anhydride is grafted having a density of 0.90~0.93 g/cm$^3$ and a 3~6 melt index.

EMBODIMENT 3

Make an organic PTC composite by adding 70 w % of carbon black, 0.3 w % of antioxidant and 0.2 w % of peroxidic cross-linking agent into 100 w % of the organic polymer which contains 35 w % of HDPE having a density of 0.95~0.965 g/cm$^3$ and a 3~6 melt index, 35 w % of LDPE having a density of 0.90~0.93 g/cm$^3$ and a 3~6 melt index, 10 w % of EVA and 20 w % of LDPE on which maleic anhydride is grafted having a density of 0.90~0.93 g/cm$^3$ and a 3~6 melt index.

EMBODIMENT 4

Make an organic PTC composite by adding 70 w % of carbon black, 0.3 w % of antioxidant and 0.2 w % of peroxidic cross-linking agent into 100 w % of the organic polymer which contains 40 w % of HDPE having a density of 0.95~0.965 g/cm$^3$ and a 3~6 melt index, 40 w % of LDPE having a density of 0.90~0.93 g/cm$^3$ and a 3~6 melt index, 10 w % of EVA and 10 w % of LDPE on which maleic anhydride is grafted having a density of 0.90~0.93 g/cm$^3$ and a 3~6 melt index.

EMBODIMENT 5

Make an organic PTC composite by adding 70 w % of carbon black, 0.3 w % of antioxidant and 0.2 w % of peroxidic cross-linking agent into 100 w % of the organic polymer which contains 30 w % of HDPE having a density of 0.95~0.965 g/cm$^3$ and a 3~6 melt index, 30 w % of LDPE having a density of 0.90~0.93 g/cm$^3$ and a 3~6 melt index, 10 w % of EVA and 30 w % of HDPE on which maleic anhydride is grafted having a density of 0.95~0.965 g/cm$^3$ and a 3~6 melt index.

EMBODIMENT 6

Make an organic PTC composite by adding 70 w % of carbon black, 0.3 w % of antioxidant and 0.2 w % of peroxidic cross-linking agent into 100 w % of LDPE on which maleic anhydride is grafted having a density of 0.90~0.93 g/cm$^3$ and a 3~6 melt index.

EMBODIMENT 7

Make an organic PTC composite by adding 70 w % of carbon black, 0.3 w % of antioxidant and 0.2 w % of peroxidic cross-linking agent into 100 w % of HDPE on which maleic anhydride is grafted having a density of 0.95~0.965 g/cm$^3$ and a 3~6 melt index.

COMPARATIVE EXAMPLE 1

Do not add the peroxidic cross-linking agent to the organic polymer of the second embodiment, so making a PTC composite without cross-linking reaction.

COMPARATIVE EXAMPLE 2

Do not add the peroxidic cross-linking agent to the organic polymer of the fifth embodiment so making a PTC composite without cross-linking reaction.

Hereinafter, tests for temperature-resistance characteristics and current-time characteristics of the PTC composite in each embodiment and each comparative example are presented.

Test 1

A test method and experimental instruments used for testing the temperature-resistance characteristics are as follows.

1) Test Sample

The sample for the test 1 is obtained by uniting the PTC composites of the embodiments 1 to 4 with the metal electrodes, cross-linking the united device with pressure for 20~30 minutes and then cooling it for 10 minutes.

2) Test Method a temperature range for measurement: −40° C.~180° C.

a temperature interval for measurement: 10° C.

a waiting period at each measurement temperature: 15 minutes

3) Experimental Instruments a temperature rising/falling rate in a chamber: at least 1° C./min a resistance measuring device: HP 34401A (test current: less than 1 mA, measuring range: 0.1 mΩ~100 MΩ)

Figure 2:
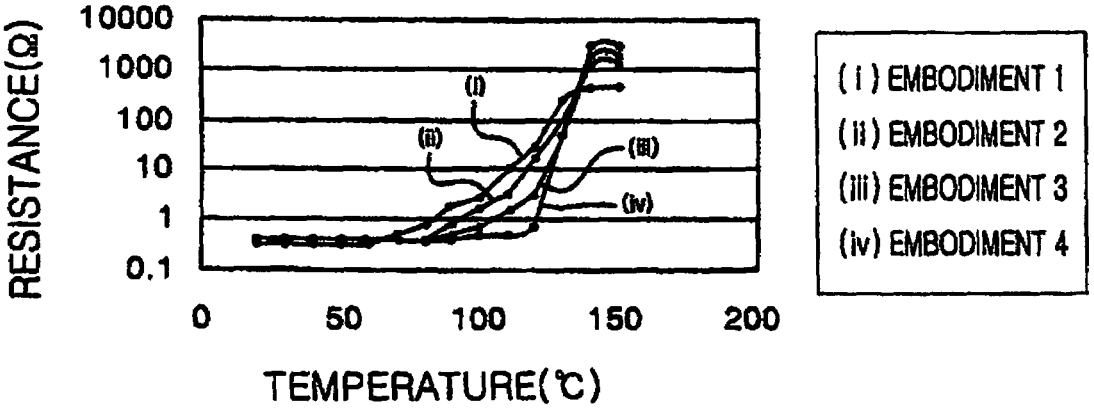
FIG. 2 is a graph for illustrating a temperature-resistance characteristic of the composites according to first to fourth embodiments of the present invention.
Figure 3:
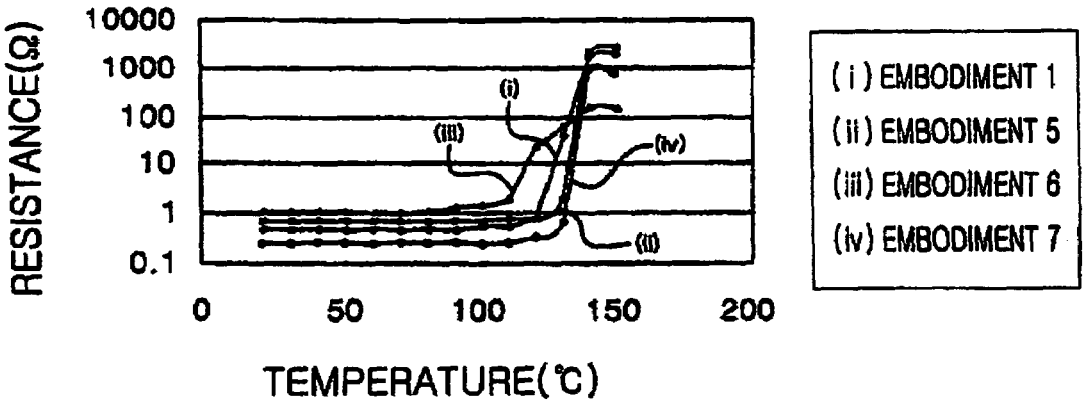
FIG. 3 is a graph for illustrating a temperature-resistance characteristic of the composites according to second, fifth, sixth and seventh embodiments of the present invention.

Results of the test 1 for the temperature-resistance characteristics of the test sample according to the embodiments of the present invention are well shown in FIG. 2.

As shown in FIG. 2, it can be easily understood that a switching temperature of the PTC composite increases as an added amount of the polyolefin, on which maleic anhydride is grafted, decreases. In other words, it can be easily found that a switching temperature of the embodiment 4 is greater than that of the embodiment 2. At this time, the switching temperature means a temperature at the point that a resistance suddenly increases depending on changing temperature. Therefore, it should be acknowledged that the switching temperature could be determined as desired by adjusting an added amount of the polyolefin on which maleic anhydride is grafted.

In addition, a resistance after repeated measurements of the temperature-resistance characteristics (R2) and a resistance before the measurement (R0) are compared. The electrical device of the present invention maintains a ratio R2/R0 less than 2.0 at every test until 1,000 times of the test, and preferably 1.0~2.0.

Moreover, the electrical device also maintains the ratio R2/R0 between 1.0 and 2.0 even when a ratio of a maximum resistance to a resistance at an ambient temperature is more than $10^6$.

Test 2

A test method and experimental instruments used for testing the current-time characteristics are as follows.

1) Test Sample

The test sample for the test 2 is obtained by uniting the PTC composites of the embodiments 1 to 7 with the metal electrodes, cross-linking the united device with pressure for 20~30 minutes and then cooling it for 10 minutes.

2) Test Method a set voltage: 15V DC (depending on conditions)

a set current: 10 A DC (depending on conditions)

a time interval for measurement: 10 ms

3) Experimental Instruments a power supply: 20V/40 A DC a voltage and current measuring device: shunt (1.01V/0.01 A resolution) was used 4) Trip Time The trip time is defined as the time taken for a fault current to be reduced as much as ½. For example, if voltage and current are set as 15V/10 A, the trip time is a time required to decrease the current to 5 A. At this time, the resistance of the PTC element becomes 3Ω.

Results of the test 2 for the current-time characteristics of the test sample according to the embodiments of the present invention are described in Table 1 below.

TABLE 1

| | Embodiment | | | | | | |
|---|---|---|---|---|---|---|---|
| | 1 | 2 | 3 | 4 | 5 | 6 | 7 |
| Trip time (sec) | 4~5 | 7~8 | 6~7 | 5~6 | 7~8 | 8~9 | 9~10 |

As shown in Table 1, it can be easily understood that a trip time of the PTC composite decreases as an added amount of the polyolefin on which maleic anhydride is grafted decreases. In particular, the trip time decreases as an added amount of LDPE on which maleic anhydride is grafted decreases. However, if the PTC composite consists of only polyethylene on which maleic anhydride is grafted like the embodiments 6 and 7, the trip time rather tends to increase.

In addition, a resistance after repeated measurements of the temperature-resistance characteristics (R1) and a resistance before the measurement (R0) are compared. The electrical device of the present invention maintains a ratio R1/R0 less than 1.5 at every test until 1,000 times of the test, and preferably between 1.0 and 1.5.

Moreover, in test for a current-time characteristics, the electrical device also maintains the ratio R1/R0 between 1.0 and 2.5 after 10 hours in a tripped state.

Test 3

Temperature-resistance characteristics for an electrical device containing the PTC composites of the embodiments 2 and 5 and an electrical devices containing PTC composites of the comparative examples 1 and 2 which is made without cross-linking reaction are tested with the same method as the test 1.

Figure 4:
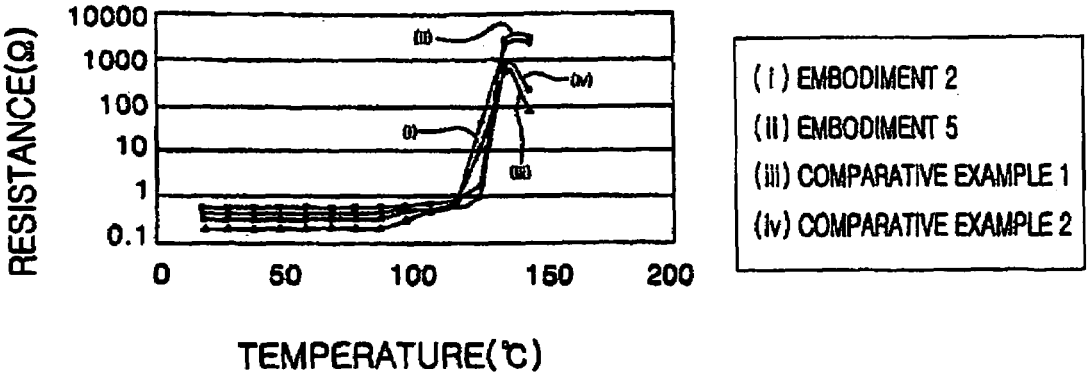
FIG. 4 is a graph for illustrating a temperature-resistance characteristic according to the second and fifth embodiments of the present invention and a comparative example without using a cross-linking agent.

Results of the test 3 are well shown in FIG. 4. As shown in FIG. 4, the electrical devices according to the embodiments 2 and 5 experiencing cross-linking reaction maintain a resistance more than 1,000Ω at above 140° C., while the electrical devices of the comparative examples have a resistance less than 1,000Ω at above 140° C.

In other words, supposing that a resistance of an electrical device at more than 140° C. is R3 and an initial resistance at an ambient temperature is R0, the electrical devices of the embodiments 2 and 5 maintain a ratio R3/R0 more than $10^5$, while the electrical devices of the comparative examples shows the ratio R3/R0 less than $10^5$.

INDUSTRIAL APPLICABILITY

Therefore, the electrical device using the organic PTC composite of the present invention has an advantage that its PTC characteristics can be controlled as desired by adjusting an added amount of polyethylene on which maleic anhydride is grafted into maleic anhydride.

In particular, as an added amount of the maleic anhydride grafted polyethylene decreases, the switching temperature increases and the trip time decreases.

In addition, the electrical device of the present invention, which is made using chemical cross-linking reaction with peroxidic cross-linking agent, shows excellent heat stability rather than other electrical devices, which have not experienced the cross-linking reaction.

The organic PTC composite, the method of controlling the PTC composite and the electrical device containing the PTC composite according to the present invention have been described in detail. However, it should be understood that the detailed description and specific examples, while indicating preferred embodiments of the invention, are given by way of illustration only, since various changes and modifications within the spirit and scope of the invention will become apparent to those skilled in the art from this detailed description.

What is claimed is:

1. An organic positive temperature coefficient (PTC) composite which realizes PTC characteristics by dispersing electrical conductive particles into organic polymer:

wherein the conductive composite includes 0.2~0.5 w % of peroxidic cross-linking agent added into 100 w % of the organic polymer for cross-linking reaction, and wherein the organic polymer comprises, (1) polyolefin component containing 30~40 w % of high density polyethylene (HDPE), 20~40 w % of low density polyethylene (LDPE) and 10~30 w % ethylene-acrylic-acid (EAA) or ethylene-vinyl-acetate (EVA); and (2) 20~30 w % of HDPE or LDPE, on which maleic anhydride is grafted, added to the polyolefin component, whereby a switching temperature and a trip time are controlled by suitably adjusting an added amount of the maleic anhydride grafted polyethylene.

2. The organic PTC composite according to claim 1, wherein 60~120 w % of the electrical conductive particles are dispersed into 100 w % of the organic polymer.

3. The organic PTC composite according to claim 2, further comprising an antioxidant, which is 0.2 to 0.5% by weight of the organic polymer.

4. The organic PTC composite according to claim 2, wherein the organic PTC composite has a resistivity of 0.8~2.0 Ω-cm at an ambient temperature.

5. The organic PTC composite according to claim 3, wherein the organic PTC composite has a resistivity of 0.8~2.0 Ω-cm at an ambient temperature.

6. A method of controlling positive temperature coefficient (PTC) characteristics of an organic PTC composite which is made by dispersing electrical conductive particles such as carbon black into polyolefin component containing 30~40 w % of high density polyethylene (HDPE), 20~40 w % of low density polyethylene (LDPE) and 10~30 w % ethylene-acrylic-acid (EAA) or ethylene-vinyl-acetate (EVA) and then cross-linking the polyolefin component with peroxidic cross-linking agent, wherein the method comprises the step of controlling a switching temperature (Ts) and a trip time by adding 20~30 w % of HDPE or LDPE, on which maleic anhydride is grafted, to the polyolefin component.

7. The method of controlling PTC characteristics of the organic PTC composite according to claim 6, wherein, as an added amount of the maleic anhydride grafted polyethylene increases, the switching temperature decreases and the trip time increases.

8. An electrical device comprising:

1) a PTC element including:

a) organic polymer made by adding 20~30 w % of high density polyethylene (HDPE) or low density polyethylene (LDPE), on which maleic anhydride is grafted, into polyolefin components containing 30~40 w % of HDPE, 20~40 w % of LDPE and 10~30 w % ethylene-acrylic-acid (EAA) or ethylene-vinyl-acetate (EVA);

b) 60~120 w % of electrical conductive particles dispersed into 100 w % of the organic polymer; and c) 0.2~0.5 w % of peroxidic cross-linking agent added into 100 w % of the organic polymer for cross-linking reaction, 2) a pair of electrodes connectable to a power source, respectively, the electrodes allowing current to flow through the PTC element when being connected to the power source.

9. The electrical device according to claim 8, wherein, when testing a current-time characteristic of the electrical device with 1,000 successive cyclic tests under the condition that the trip time is set to a time when a resistance of the device becomes 10Ω and an added overload current is set to 5 A, a ratio R1/R0 is maintained between 1.0 and 1.5 at every test, where R1 is a resistance after the test and R0 is a resistance before the test.

10. The electrical device according to claim 9, wherein, in the current-time characteristic test, the ratio R1/R0 is maintained between 1.0 and 2.5 since the electrical device is in a tripped state for 10 hours.

11. The electrical device according to claim 8, wherein, when testing a temperature-resistance characteristic of the electrical device with 10 successive cyclic tests, a ratio R2/R0 is maintained between 1.0 and 2.0 at every test, where R2 is a resistance after the test and R0 is a resistance before the test.

12. The electrical device according to claim 11, wherein the ratio R2/R0 is maintained between 1.0 and 2.0 at every test even when a ratio of a maximum resistance to a resistance at an ambient temperature is more than $10^6$.

13. The electrical device as claimed in claim 12, wherein, in a temperature-resistance test, a ratio R3/R0 is maintained more than $10^5$ at 140° C. or more, where R3 is a peak resistance and R0 is an initial resistance.

* * * * *